US005946532A

United States Patent [19]

Ichinokawa

[11] Patent Number: 5,946,532

[45] Date of Patent: Aug. 31, 1999

[54] VARIABLE MAGNIFICATION OPTICAL SYSTEM WITH LIGHT SHIELDING MECHANISM

[75] Inventor: Kazuhiro Ichinokawa, Tokyo, Japan

[73] Assignee: Asahi Kogaku Kogyo Kabushiki Kaisha, Tokyo, Japan

[21] Appl. No.: 09/083,992

[22] Filed: May 26, 1998

Related U.S. Application Data

[62] Division of application No. 08/633,524, Apr. 17, 1996, abandoned.

[30] Foreign Application Priority Data

Apr. 20, 1995 [JP] Japan ..... 7-119263
Apr. 20, 1995 [JP] Japan ..... 7-119264
Apr. 20, 1995 [JP] Japan ..... 7-119265

[51] Int. Cl.[6] ..... G03G 15/041

[52] U.S. Cl. ..... 399/196; 355/67; 399/200; 399/207

[58] Field of Search ..... 399/196, 207, 399/200–202; 355/55, 67; 358/474, 497

[56] References Cited

U.S. PATENT DOCUMENTS 4,050,812 9/1977 Koizumi et al. ..... 355/67 X
4,322,159 3/1982 Takahashi et al. .
4,407,581 10/1983 Shogren et al. .
4,412,737 11/1983 Iwanade et al. .
4,420,248 12/1983 Ogawa et al. .
4,474,462 10/1984 Ogawa et al. .
4,792,826 12/1988 Suzuki .
4,796,053 1/1989 Nakamura et al. ..... 399/200
4,801,969 1/1989 Hamidian ..... 399/207
5,012,277 4/1991 Hyodo et al. ..... 355/55
5,065,189 11/1991 Mizude .

*Primary Examiner*—William Royer
*Attorney, Agent, or Firm*—Greenblum & Bernstein, P.L.C.

[57] ABSTRACT

A lens is moved by a lens moving member in the direction of its optical axis, and a mirror group is moved by a mirror moving member in the direction of the optical axis of the lens. The moving ranges of the lens moving member and the mirror moving member overlap, and the mirror moving member and the lens moving member are moved at different rates or times such that the mirror moving member and lens moving member do not interfere. A flexible light shielding member on the lens moving member blocks non-image forming light from reaching the mirror group, but bends within a housing holding the moving members to allow the lens moving member to move in its full moving range. A pivotable light shielding member in the moving range of the lens moving member blocks non-image-forming light from reaching the mirror group, but pivots when the lens moving member is moved in contact with it, allowing the lens moving member to move in its full moving range.

10 Claims, 15 Drawing Sheets

VARIABLE MAGNIFICATION OPTICAL SYSTEM WITH LIGHT SHIELDING MECHANISM

This application is a divisional of application No. Ser. 08/633,524, filed Apr. 17, 1996, now abandoned, the contents of which herein incorporated by reference in its entirety.

BACKGROUND OF THE INVENTION

The present invention relates to a variable magnification optical system used in a copier or similar optical scanning device, and more particularly to a variable magnification optical system wherein a lens having a fixed focal length and a group of mirrors are moved to vary a projection magnification at the projection surface (i.e., a photoconductive drum).

A variable magnification optical system such as that in an electrophotographic copier has a lens for forming an image of an original on the projection surface, and a mirror group between the lens and the projection surface. Both of the lens and mirror group are moved in the optical axis direction to vary the distance between the surface of an original document and the lens, and to vary the distance between the lens and the projection surface, whereby both enlarging and reducing operations are performed. The lens and mirror group are mounted in respective movable members, and are accommodated in a housing and slidable in the direction of the optical axis of the lens. The housing shields non-image-forming light (i.e., except that in the optical axis direction), and the respective movable members are moved within moving ranges by a driving device in the housing.

Conventionally, the moving ranges of the lenses and mirror group are arranged in series in the optical axis direction, so that if the magnification range is increased, the length of the movement of the lens and mirrors increases. In this case, the space occupied by the magnification changing portions of the optical system is enlarged, and a lens having a long focal length becomes necessary. Accordingly, it is difficult to make the copier compact.

Light shielding members movable within the housing can further increase the size of the housing. That is, horizontal and movable flat plate light shielding members (for example, being made of metal) provided to shield the stray light that intrudes from above the housing when the lens is moved to different magnification positions, can interfere with the side walls housing, and the lens cannot reach all magnification positions. Accordingly, it becomes necessary to form an opening in the side walls of the housing for allowing the shielding member, or to make the housing longer in the optical axis direction. In order to allow the shielding member to protrude from the opening in the rear wall, it becomes necessary to have vacant space at the rear side of the housing, and it is thereby difficult to install parts in the rear side of the housing.

Still further, in a conventional variable magnification optical system, as a movable member supporting the lens is moved in the optical axis direction, a space is formed between the outer peripheral area of the moving member and the inner peripheral area of the housing. However, this space functions as a passage for stray light generated by diffuse reflection from the original document. Particularly, stray light passing through the space formed at both sides of the lens moving member can reach the projection surface via the mirror group, thereby causing flare and/or lack of contrast on the projected image.

In order to avoid this, it can be considered to provide a light shielding member for shielding stray light penetrating the space at the sides of the lens moving member. However, with this construction, when the lens moving member moves, it interferes with the light shielding member.

SUMMARY OF THE INVENTION

It is therefore an object of the present invention to provide an improved variable magnification optical system having a large magnification changing range in a compact construction.

It is a further object of the present invention to provide an improved variable magnification optical system capable of shielding stray light without interfering with a housing of the variable magnification optical system.

It is a still further object of the present invention to provide an improved variable magnification optical system capable of shielding stray light without interfering with movable members for supporting portions of the variable magnification optical system.

In order to meet these objects, according to one aspect of the present invention, a variable magnification optical system for projecting an image onto a projection surface includes: a lens for forming an image of an original document on the projection surface; a lens moving member supporting the lens; a mirror group arranged between the lens and the projection surface, for directing light from the lens to the projection surface; a mirror moving member supporting the mirror group; a lens driving mechanism that drives the lens moving member in a direction of the optical axis of the lens to vary the magnification of the projected image by varying an optical path between the original document and the lens, the lens driving mechanism driving the lens moving member within a predetermined lens moving range; a mirror driving mechanism that drives the mirror moving member in the direction of the optical axis of the lens to vary the magnification of the projected image by varying an optical path between the lens and the projection surface, the mirror driving mechanism driving the mirror moving member within a predetermined mirror moving range; wherein the predetermined lens moving range and the predetermined mirror moving range overlap.

Accordingly, since the moving range of the lens moving member and the mirror moving member overlap, less space is required to construct a fully functional variable magnification optical system, and the copier or other optical scanning device can be made compact.

Preferably, the lens driving mechanism drives the lens moving member with reference to a lens origin point position along the optical axis direction, and the mirror driving mechanism drives the mirror moving member with reference to a mirror origin point position along the optical axis direction.

By referring to origin point positions, the positions of the lens moving member and the mirror moving member can be calibrated at any time with reference to a known position, and the movements of the two members can be easily synchronized to provide the proper optical path lengths. In one preferred embodiment, the lens origin point position and the mirror origin point position are on the same side of the overlap. In a second preferred embodiment, the lens origin point position and the mirror origin point position are on opposite sides of the overlap.

According to one development of this aspect of the invention, the variable magnification optical system further includes: a controller that controls the driving of the lens driving mechanism and the mirror driving mechanism; a lens origin point sensor, connected to the controller, that detects when the lens moving member moves to the lens origin point position; and a mirror origin point sensor, connected to the controller, that detects when the mirror moving member moves to the mirror origin point position.

The sensors and controller ensure that the positioning and movement of the lens moving member and the mirror moving member are accurately and repeatably performed with reference to reliably sensed origin point positions.

Preferably, the variable magnification optical system further includes a power source connected to the controller, and the controller controls the lens driving mechanism to return the lens moving member to the lens origin point position, detected by the lens origin point sensor, and controls the mirror driving mechanism to return the mirror moving member to the mirror origin point position, detected by the mirror origin point sensor, when the power source is turned on.

In this manner, each time the copier or other optical scanning device is turned on, the positions and movement of the lens moving member and the mirror moving member are accurately calibrated with reference to the respective origin point positions.

According to a particularly favorable development of this aspect of the invention, the mirror driving mechanism is controlled by the controller to return to the mirror origin point position at a faster rate than the lens origin point position returns to the lens origin point position. In this case, even though the moving ranges of the lens moving member and the mirror moving member overlap, the two members cannot strike each other, as the speed difference makes the distance between the mirror moving member and the lens moving member increase.

According to another particularly favorable development of the this aspect of the invention, the mirror driving mechanism is controlled by the controller to return to the mirror origin point position before the lens origin point position returns to the lens origin point position. In this case, the mirror moving member is moved out of the overlapping range before the lens moving member is moved into the overlapping range, and the two members cannot interfere with each other.

According to another aspect of the invention, a variable magnification optical system for projecting an image onto a projection surface includes: a lens for forming an image of an original document on the projection surface, the lens having an optical axis; a lens moving member supporting the lens; a mirror group arranged between the lens and the projection surface, for directing light from the lens to the projection surface; a lens driving mechanism that drives the lens moving member in a direction of the optical axis of the lens to vary the magnification of the projected image; a housing having a bottom base plate, a front side at one end in the direction of the optical axis, and a rear side in the direction of the optical axis, the housing being open at a top side, and the housing accommodating the lens, the lens moving member, the mirror group, and the lens driving mechanism; a light shielding cover shielding a top side of the base plate and extending from the rear side of the housing toward the front side of the housing, a space for allowing image-forming light into the housing being formed between the light shielding cover and the front side of the housing; a flexible lens shielding member attached to an upper portion of the lens moving member, the flexible lens shielding member extending in the direction of the rear side of the housing, and the flexible lens shielding member sized to block the space between the light shielding cover and the front side of the housing; and a guide member formed at the rear side of the housing for urging the flexible lens shielding member in a downward direction when the lens moving member is moved to the rear side of the housing.

Accordingly, even though the flexible light shielding member is sufficiently long in the optical axis direction to block the space between the light shielding cover and the housing, since the flexible light shielding member is urged downward within the housing, it is not necessary to provide an opening in the housing for the flexible light shielding member to project, or to enlarge the housing, in order for the lens moving member to have a sufficiently long range of movement.

Preferably, the flexible light shielding member is formed of a resilient material having elasticity. In one particular development, the guide member is attached to the light shielding cover. Further preferably, the variable magnification optical system also includes: a mirror driving mechanism that drives the mirror moving member in a direction of the optical axis of the lens to vary the magnification of the projected image in response to the driving of the lens moving member.

According to still another aspect of the invention, a variable magnification optical system for projecting an image onto a projection surface includes: a lens for forming an image of an original document on the projection surface; a lens moving member supporting the lens; a mirror group arranged between the lens and the projection surface, for directing light from the lens to the projection surface; a mirror moving member supporting the mirror group; a lens driving mechanism that drives the lens moving member in a direction of the optical axis of the lens to vary the magnification of the projected image; a housing accommodating the lens, the lens moving member, the mirror group, the mirror moving member, and the lens driving mechanism; a light shielding member, inclinably supported by a portion of the housing in the moving range of the lens moving member, that blocks light from passing beside the lens moving member to the mirror group when the light shielding member is in an upright position; and a biasing member that biases the light shielding member to the upright position.

In this case, the lens moving member can be moved between magnification positions without interfering with the light shielding member. Furthermore, while the lens moving member is being moved, the light shielding member can be held in an upright position, and stray light reflected from the original document can be surely blocked from intruding to the mirror group.

In a particularly favorable development of the invention, the variable magnification optical system further includes: a pivot support provided on a surface of the housing in a moving range of the lens moving member that swingably supports the light shielding member to be inclinable and swingable about an axis. In this manner, the swingable light shielding member can be substantially rigid. yet can be swung out of the path of the lens moving member when the lens moving member enters that part of its moving range in which the light shielding member is positioned.

In this case, the lens moving member preferably includes a surface contactable to the light shielding member, wherein the lens moving member inclines the light shielding member when the surface contacts and pushes the light shielding member. Consequently, the light shielding member can be swung out of the path of the lens moving member solely by the movement of the lens moving member itself.

In one particular embodiment, the surface contactable to the light shielding member is a cutoff portion formed in the lens moving member and facing the portion of the housing supporting the light shielding member.

The cutoff portion can hold the light shielding member in a position substantially parallel to the direction of movement of the lens moving member, thereby allowing both the free movement of the lens moving member and the holding of the light shielding member in the inclined position.

In one development of this aspect of the invention, the variable magnification optical system further includes: a flexible lens shielding member attached to a side portion of the lens moving member, the flexible lens shielding member away from the lens moving member and toward the housing, and the flexible lens shielding member sized to block a spacing between the lens moving member and a side of the housing. Accordingly, stray light is prevented from intruding to the mirror group through the spacing between the lens moving member and the side of the housing.

Preferably, the variable magnification optical system according to this aspect of the invention further includes a mirror driving mechanism that drives the mirror moving member in the direction of the optical axis of the lens to vary the magnification of the projected image in response to the driving of the lens moving member.

DETAILED DESCRIPTION OF THE PREFERRED EMBODIMENTS

Figure 1:
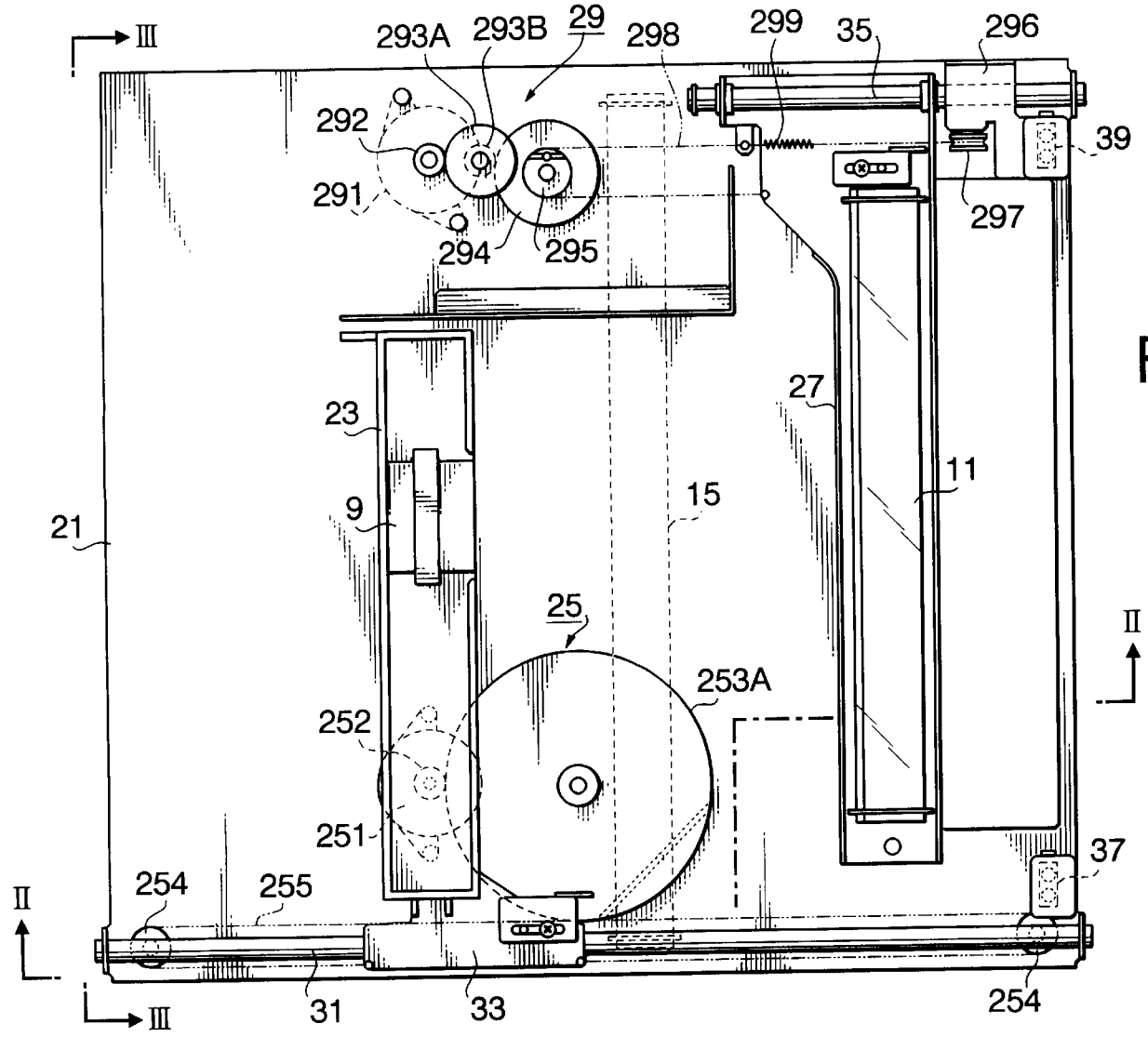
FIG. 1 is a plan view of a variable magnification optical system to which the embodiments of the invention are applied.
Figure 2:
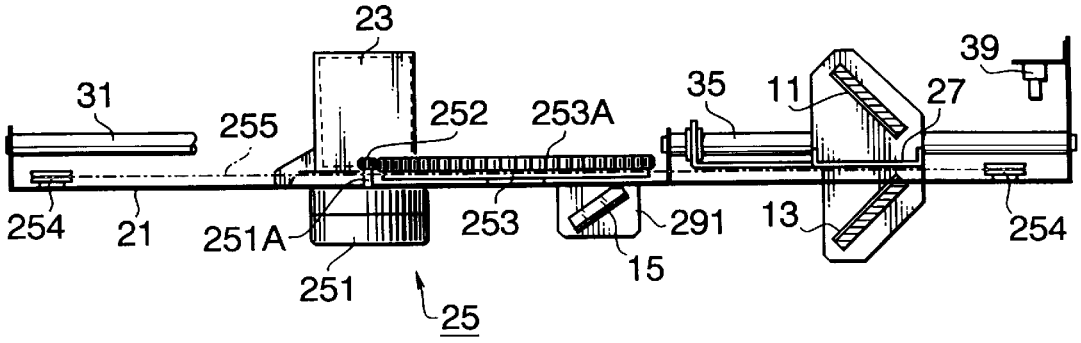
FIG. 2 is a cross-sectional side view taken along the line II—II of FIG. 1.
Figure 3:
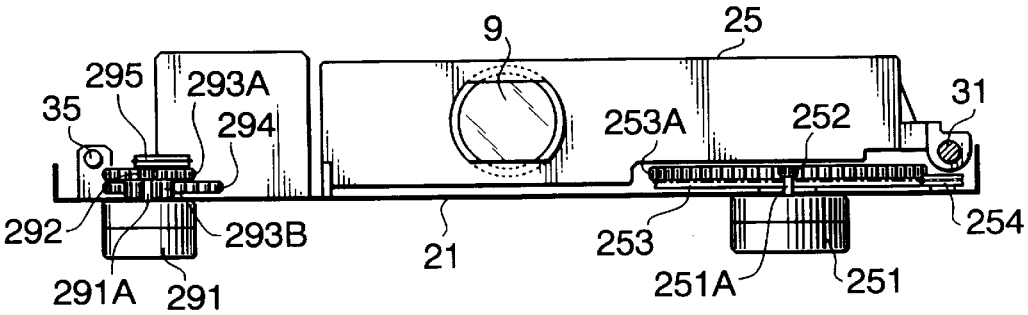
FIG. 3 is a front view from line III—III of FIG. 1.
Figure 4:
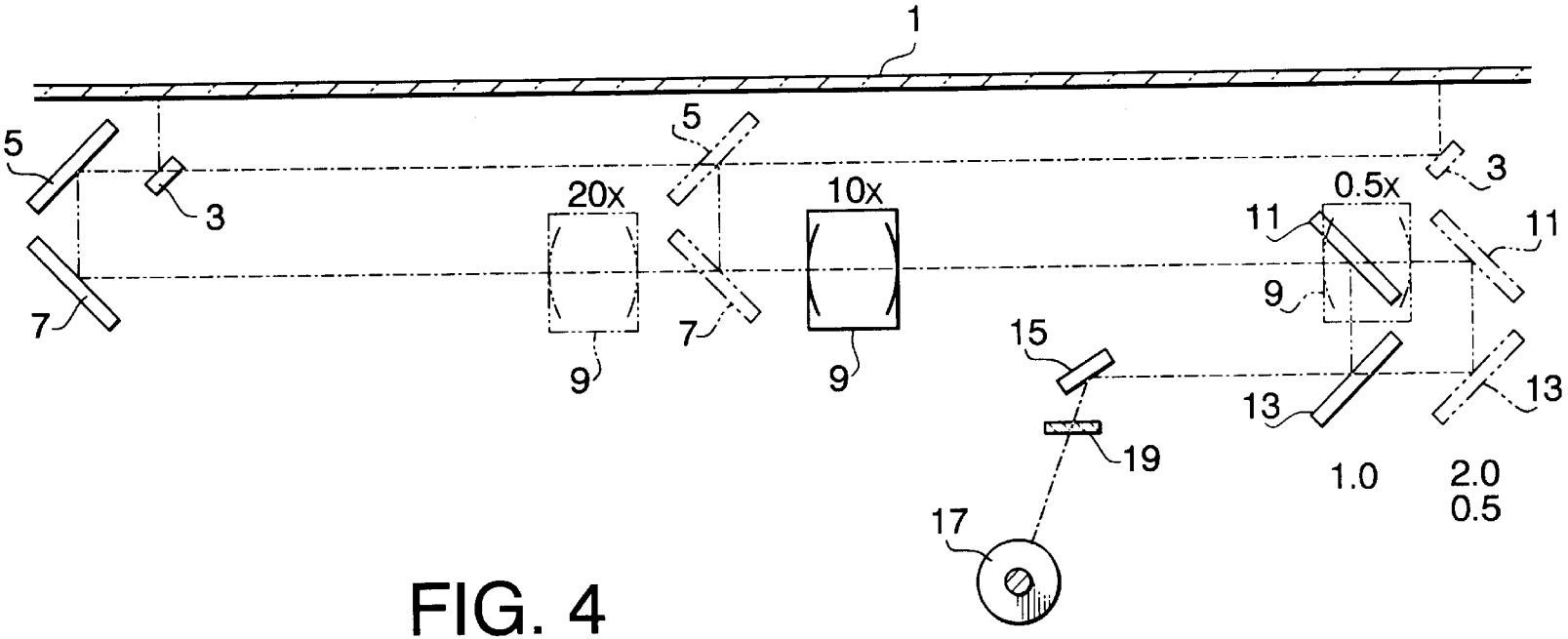
FIG. 4 is a schematic side view showing the basic operation of the variable magnification optical system to which the embodiments of the invention are applied.

A variable magnification optical system to which the embodiments of the invention are applied is shown in FIGS. 1 through 4. FIG. 1 is a plan view of a variable magnification optical system to which the embodiments of the invention are applied; FIG. 2 is a cross-sectional side view taken along the line II—II of FIG. 1; FIG. 3 is a front view taken from line III—III of FIG. 1; and FIG. 4 is a schematic side view showing the basic operation of the variable magnification optical system to which the embodiments of the invention are applied.

As shown in FIGS. 1 and 2, the variable magnification optical system includes a rectangular base plate 21 constituting a housing for shielding non-image-forming light and external light (i.e., excluding the original document reading light). Within the rectangular base plate 21, a lens 9 and first and second magnification mirrors 11 and 13 are supported and arranged to be movable in the direction of the optical axis of the lens 9 (parallel to the scanning direction of the variable magnification optical system).

The lens 9 is supported and. movable by means of a lens moving member 23, movable with respect to the base plate 21 (in the right and left direction from the viewpoint of FIGS. 1 and 2) within a predetermined moving range and a drive mechanism 25 for driving the lens moving member 23. The first and second magnification mirrors 11 and 13 are supported and movable by means of a mirror moving member 27 which is movable on the base plate 21 (in the right and left direction from the viewpoint of FIGS. 1 and 2) within a predetermined moving range and a driving mechanism 29 for driving the mirror moving member 27. The base plate 21 is covered by a light shielding cover 85 (shown in FIG. 12) for covering the upper area of the base plate 21, and for shielding non-image-forming light from an original document.

The lens moving member 23 is a rectangular sleeve extending in the vertical direction of the base plate 21 (i.e., the up and down direction in FIG. 2). The lens moving member 23 supports the lens 9 horizontally, with the optical axis of the lens 9 coincident with the moving direction of the lens moving member 23. In order to move the lens moving member 23 with respect to the base plate 21, one lateral end of the lens moving member 23 is coupled to a guide sleeve 33 that slidably engages a guide rod 31 extending in the optical axis direction along one side of the base plate 21, while the remaining lateral end engages the surface of the base plate 21, but is movable in the optical axis direction.

As shown in FIGS. 2 and 3, the drive mechanism 25 for the lens moving member 23 includes a stepping motor 251, secured to the underside of the base plate 21 and having a rotary shaft 251A projecting through the base plate 21, and a pinion 252 secured to the rotary shaft 251A. A drive pulley 253A having a gear 253A is rotatably supported on the base plate 21 adjacent to the pinion 252, and the gear 253 meshes with the pinion 252. Driven pulleys 254, 254, rotatably supported on the base plate 21, are arranged near either end (in the optical axis direction) of the guide rod 31 (see FIG. 1). A wire 255 is wound several times about the drive pulley 253, is looped about each driven pulley 254, 254, and is connected at each end to opposite sides of the guide sleeve in the optical axis direction. Accordingly, when the drive pulley 253 is turned, the guide sleeve 33 is moved in the optical axis direction.

The mirror moving member 27 is formed as a plate member extending in the vertical width direction of the base plate 21. The first and second magnification mirrors 11 and 13 are symmetrically arranged on the upper surface and lower surface sides of the mirror moving member 27. In order to move the mirror moving member 27 in the optical axis direction with respect to the base plate 21, one lateral end of the mirror moving member 27 is movably coupled to a guide rod 35 provided at a lateral side of the base plate 21 and extending in the optical axis direction, while the remaining lateral end engages the surface of the base plate 21, but is movable in the optical axis direction.

The driving mechanism 29 for the mirror moving member 27 includes a stepping motor 291 attached to the underside of the base plate 21 at one end of the guide rod 35, and having a rotary shaft 291A projecting through the base plate 21. A pinion 292 is secured to the rotary shaft 291A and engages a first intermediate gear 293A rotatably supported on the base plate 21 adjacent. to the pinion 292. A second intermediate gear 293B is coaxially fixed to the first intermediate gear 293A.

A drive pulley 295, having a gear 294 engaging with the adjacent second intermediate gear 293B, is rotatably supported on the base plate 21. A bracket 296 provided on the base plate 21 at the remaining end of the guide rod 35 rotatably supports a guide pulley 297. A wire 298 is wound several times about the drive pulley 295, is looped about the guide pulley 297, and is connected at one end to one side (in the optical axis direction) of the mirror moving member 27 via a spring 299 and at the other end to an opposite side (in the optical axis direction) of the mirror moving member 27.

As shown in FIG. 1, a lens origin point sensor 37 is arranged near the guide rod 31. The lens origin point sensor 37 detects a lens origin point position of the lens moving member 23. A mirror origin point sensor 39 is arranged near the guide rod 35 as shown in FIGS. 1 and 2. The mirror origin point sensor 39 detects an origin point position of the mirror moving member 27, including the magnification mirrors 11 and 13.

The basic operation and associated parts of the variable magnification optical system are shown in a side schematic view in FIG. 4. As shown in FIG. 4, a glass plate 1 is positioned above a scanning mirror 3 that is movable (in left and right directions from the viewpoint of FIG. 4) with reference to the glass plate 1. The scanning mirror 3 reflects vertically projecting light from an original on the glass plate to a horizontal direction. A first redirecting mirror 5 redirects the horizontal light reflected from the scanning mirror 3 to a vertical direction, and a second redirecting mirror 7 redirects the vertical light reflected from the first redirecting mirror 5 to a horizontal direction.

The first and second redirecting mirrors 5 and 7 are mounted to be movable together linked with the scanning mirror 3, and move by half of the distance of the scanning mirror 3. The scanning mirror and first and second redirecting mirrors 5 and 7 are continuously movable to scan an original between a first position shown by a solid line in FIG. 4, and a second position shown by a double-dotted line in FIG. 4.

On the reflected light optical axis of the second redirecting mirror 7, the variable magnification optical system is positioned. The lens 9, having a fixed focal length, is slidable in the optical axis direction as described. The lens 9 has a continuous moving range between a 2.0× magnification (shown by a single dotted line in FIG. 4) and a 0.5× magnification position (shown by a double dotted line in FIG. 4).

The first magnification mirror 11, on the optical axis at the light output side of the lens 9, redirects the horizontal light passing through the lens 9 to a vertical direction, while the second magnification mirror 13 redirects the vertical light reflected from the first magnification mirror 11 to a horizontal direction. As described, the first and second magnification mirrors 11 and 13 are mounted to be movable together in the optical axis direction.

A final mirror 15 for reflecting the light from the second magnification mirror 13 toward a photoconductive drum 17 is positioned on the reflection light axis of the second magnification mirror 13, and a cover glass 19 is placed intermediate the final mirror 15 and the photoconductive drum 17.

The first and second magnification mirrors 11 and 13 have a moving range between a 1.0× magnification position (shown by a solid line in FIG. 4), and a 2.0×/0.5× magnification position (shown by a double dotted line in FIG. 4).

As described, the lens 9 and the first and second magnification mirrors 11 and 13 are moved in the optical axis direction, in accordance with the projection magnification, to change: (i) the optical path distance between the original and the lens 9, and (ii) the optical path distance between the lens 9 and the surface of the photoconductive surface of the drum 17. Accordingly, a copying magnification at the photoconductive drum 17 can be continuously and variably set between double, true, and half size.

Figure 5:
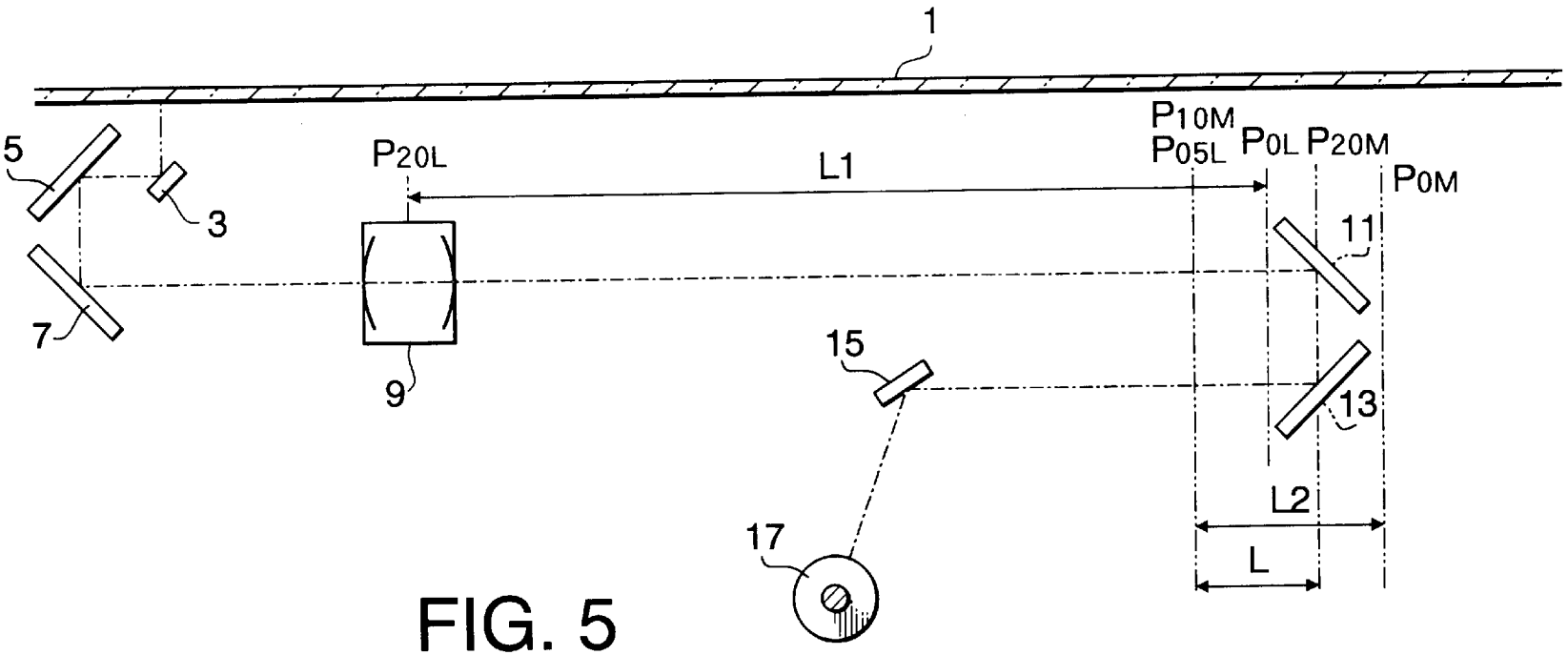
FIG. 5 is a schematic side view showing a 2.0× magnification position and moving ranges of a lens and magnification mirrors according to the first embodiment of a variable magnification optical system according to the invention.
Figure 6:
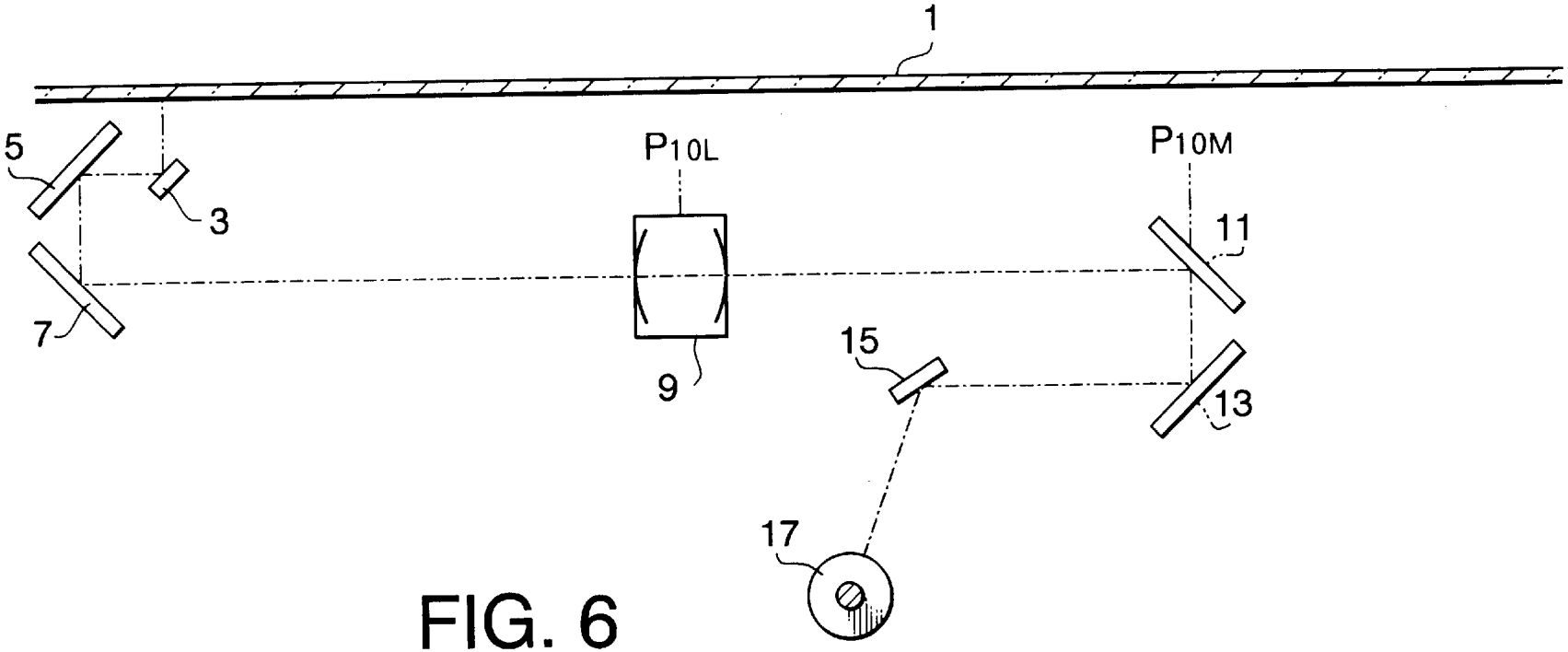
FIG. 6 is a schematic side view showing a 1.0× magnification position of a lens and magnification mirrors according to the first embodiment.
Figure 7:
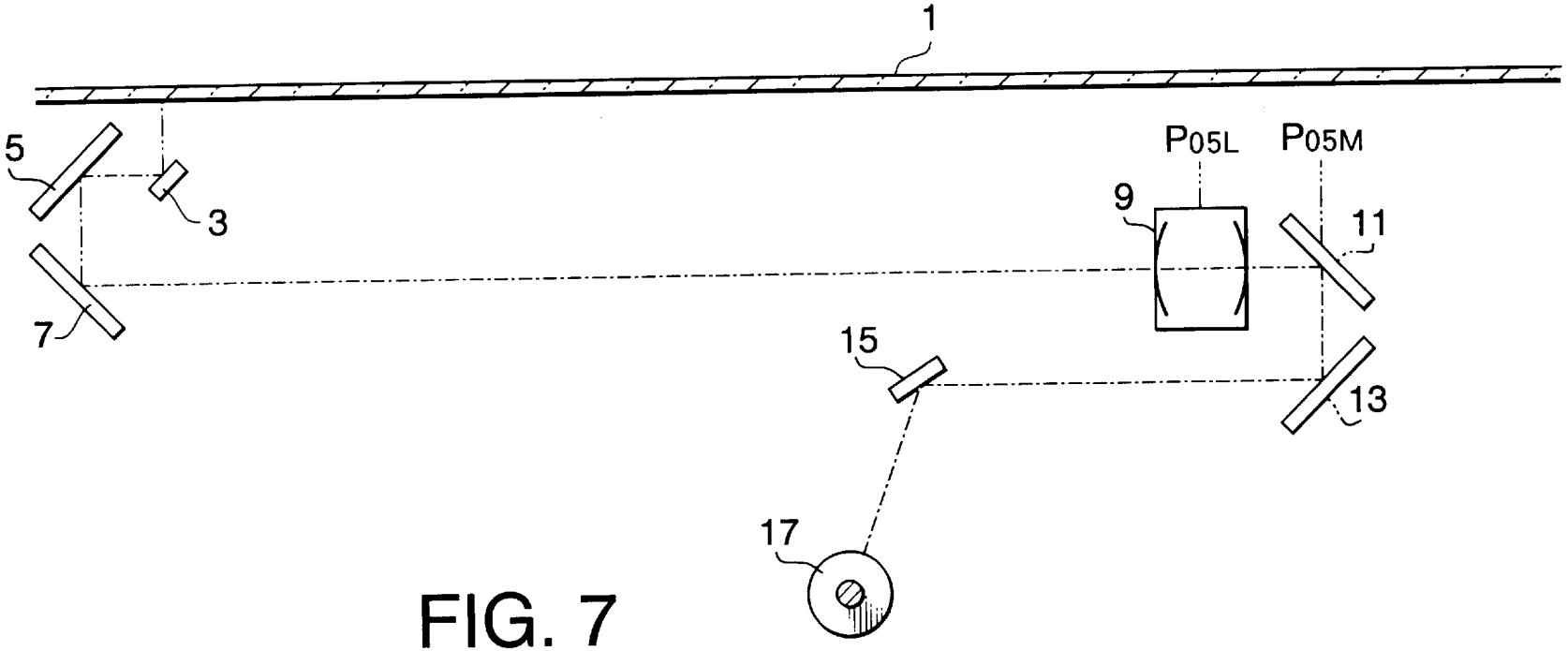
FIG. 7 is a schematic side view showing a 0.5× magnification position of a lens and magnification mirrors according to the first embodiment.

FIGS. 5, 6, and 7 show the positions and relationships of the variable magnification optical system according to the first embodiment, wherein the positions of the lens 9 and magnification mirrors 11 and 13 are continuously set between 2.0×, 1.0×, and 0.5× magnification positions, respectively. FIG. 5 is a schematic side view showing the 2.0× magnification position and moving ranges of the lens 9 and magnification mirrors 11 and 13; FIG. 6 is a schematic side view showing the 1.0× magnification position of the lens 9 and magnification mirrors 11 and 13; and FIG. 7 is a schematic side view showing the 0.5× magnification position of the lens 9 and magnification mirrors 11 and 13.

In the first embodiment of a variable magnification optical system according to the invention, as shown in FIG. 5, the lens 9 has a moving range having a length L1, and extending between positions $P_{2OL}$ (corresponding to the 2.0× magnification position for the lens 9) and the lens origin point position $P_{OL}$. The lens 9 is continuously movable within this range, moved by the lens moving member 23. The magnification mirrors 11 and 13 have a moving range of a length L2, extending between the mirror origin point position $P_{OM}$, and the position $P_{1OM}$ (corresponding to the 1.0× magnification position for the mirrors 11 and 13). The mirror origin point position $P_{OL}$ is displaced rearwardly from the origin point $P_{OL}$ of the lens 9 by an amount corresponding to the width of the first magnification mirror 11. Thus, the moving range of the lens 9 and the moving range of the magnification mirrors 11 and 13 are overlapped in a predetermined range having a predetermined length L. Accordingly, the variable magnification optical system is made compact.

Figure 8:
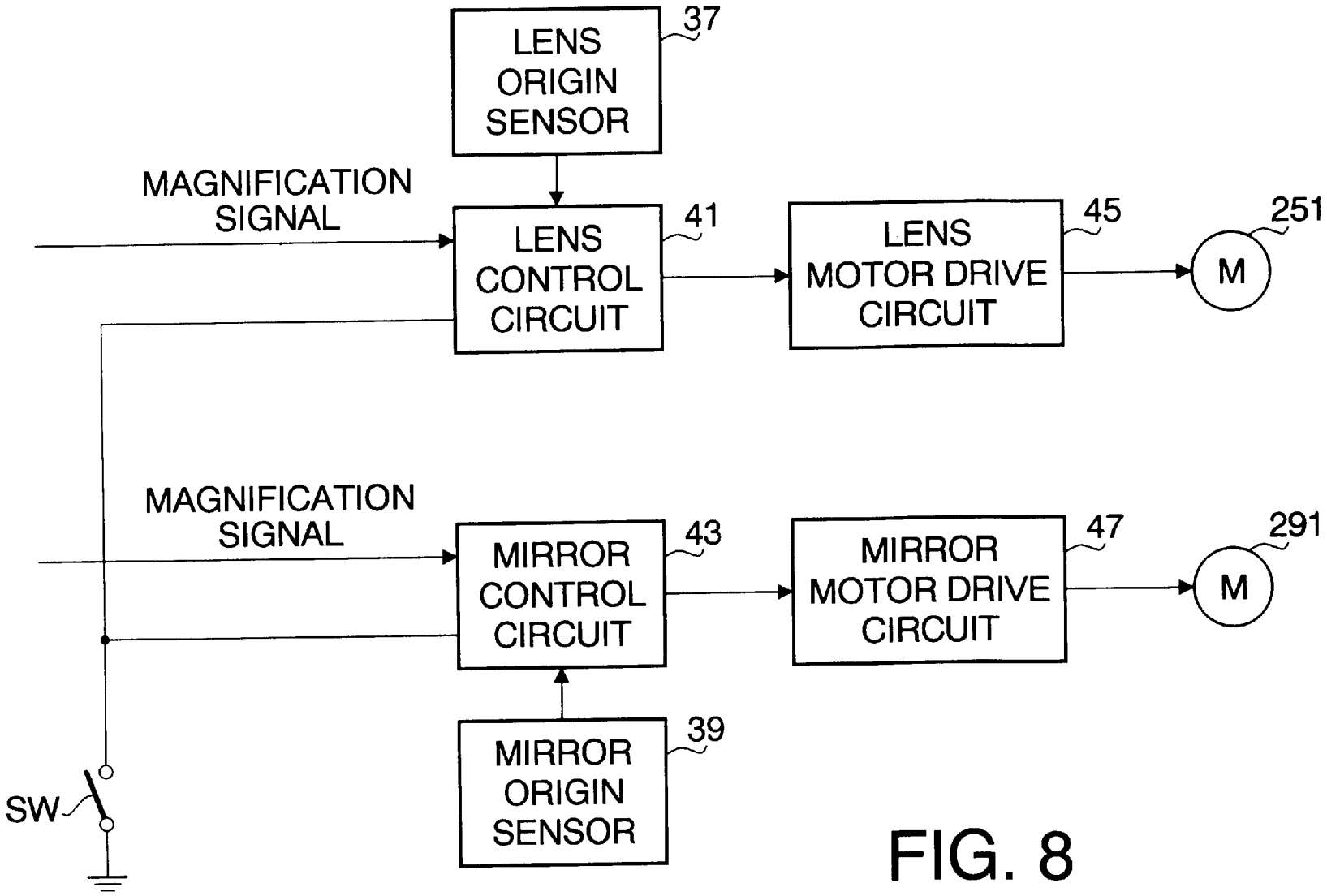
FIG. 8 is a block diagram of a control circuit of the first embodiment.

FIG. 8 is a block diagram showing a control circuit for returning the lens 9 and mirrors 11 and 13 to the lens and mirror origin point positions $P_{OL}$ and $P_{OM}$, respectively, and for driving the lens 9 and mirrors 11 and 13 to the magnification positions. A lens control circuit 41 controls the returning and magnification setting of the lens 9, while a mirror control circuit 43 controls the returning and magnification setting of the mirrors 11 and 13.

An ON signal generated when the power source switch SW of the copier is closed, as well as a magnification signal for setting the magnification of the lens 9 and mirrors 11 and 13, are input to the lens control circuit 41. The same signals are input to the mirror control circuit 43. The lens control circuit 41 is connected to the lens origin (point) sensor 37, and (via a lens motor drive circuit 45) to the stepping motor 251 for the lens. The mirror control circuit 43 is connected to the mirror origin (point) sensor 39, and (via a mirror motor drive circuit 47) to the stepping motor 291 for the mirrors 11 and 13.

In operation, when the power switch SW is closed (turned on), the ON signal is input to the control circuits 41 and 43 to start the stepping motors 251 and 291, returning the 1lns moving member 23 and the mirror moving member 27, respectively, to respective origin points. When the lens moving member 23 reaches the origin point position $P_{OL}$, an edge portion of the lens moving member 23 is detected by the lens origin point sensor 37, and the lens control circuit 41 stops the stepping motor 251 in response. Accordingly, the lens moving member 23 is stopped at its origin point position $P_{OL}$.

Similarly, when the mirror moving member 27 reaches the origin point position $P_{OM}$, the edge portion thereof is detected by the origin point sensor 39, and the mirror control circuit 43 stops the stepping motor 291 in response. Accordingly, the mirror moving member 27 is stopped at its origin point position $P_{OM}$. This constitutes a calibration step that ensures that the movements of the lens 9 and mirrors 11 and 13 are always performed with reference to a predetermined origin point.

When, for instance, an enlargement of the original document to 2.0× magnification is required, a magnification signal corresponding to the 2.0× magnification is sent by the copier controller (not shown) to the lens control circuit 41 to drive the stepping motor 251, and to the mirror control circuit 43 to drive the stepping motor 291, and the lens moving member 23 (including the lens 9) and the mirror moving member 27 (including the magnification mirrors 11 and 13) are respectively moved to the positions shown in FIG. 5. similarly, for example, when a magnification signal corresponding to the 1.0× magnification or 0.5× magnification is sent, similar operations are done to move the lens moving member 23 and the mirror moving member 27 to the positions illustrated in FIGS. 6 and 7, respectively.

In order to prevent the interference of the lens 9 and mirrors 11 and 13 when they are returned to respective origin point positions, the frequencies of the motor drive pulses output from the motor drive circuits 45 and 47 are different, making the returning speed of the magnification mirrors 11 and 13 greater than the returning speed of the lens 9. In operation, by turning on the power source SW of the copier, as described, an ON signal is input to the control circuits 41 and 43. Subsequently, in operations to return the lens 9 and magnification mirrors 11, 13 to their respective origin point positions $P_{OL}$ and $P_{OM}$, drive pulses having a higher frequency are supplied from the mirror control circuit 43 to the mirror drive circuit 47, and drive pulses having a lower frequency are supplied from the lens control circuit 41 to the lens drive circuit 45. By supplying the faster and slower drive instructions to the stepping motors 251 and 291 via the respective motor drive circuits 45 and 47, the stepping motors 251 and 291 are started.

Since the stepping motor 291 is rotated at a higher speed than that of the stepping motor 251, the mirror moving member 27 is returned to its origin point $P_{OM}$ faster than the lens moving member 23, and thereafter the lens moving member is returned to its origin point $P_{OL}$. Consequently, for example, even when the lens 9 and magnification mirrors 11 and 13 are returned to their respective origin point positions $P_{OL}$ and $P_{OM}$ from the 0.5× magnification positions shown in FIG. 7, the lens moving member 23 and the mirror moving member 27 do not interfere.

When the mirror moving member 27 moves to its origin point position $P_{OM}$, and the mirror moving member 27 is detected by the mirror origin point sensor 39, the detecting signal is input to the mirror control circuit 43. Consequently, the mirror control circuit 43 ceases generating drive pulses, the stepping motor 291 is stopped, and the mirror moving member 27 is held at its origin point position $P_{OM}$. Similarly, when the lens moving member 23 moves to its origin point position $P_{OL}$, and the lens moving member 23 is detected by the lens origin point sensor 37, the detecting signal is input to the lens control circuit 41. Consequently, the lens control circuit 41 ceases generating drive pulses, the stepping motor 251 is stopped, and the lens moving member 23 is held at its origin point position $P_{OL}$.

As described, in the first embodiment of a variable magnification optical system, the moving range of the lens moving member 23 including the lens 9 (i.e., the range between the positions $P_{2OL}$ and $P_{OL}$, having a length L1) overlaps the moving range of the mirror moving member 27 including the magnification mirrors 11 and 13 (i.e., the range between $P_{OM}$ and $P_{1OM}$, having a length L2) in a predetermined range having the predetermined length L. Accordingly, the length of the movement of the lens and mirror group in the magnification becomes smaller, and the lens having a fixed focal length that is relatively short is available, and without decreasing the range of the variable magnification, the variable magnification optical system can be made compact.

As described in this first embodiment, in order to prevent interference between the lens 9 and magnification mirrors 11 and 13, the returning speed of the mirror moving member 27 is set to be larger than that of the lens moving member 23, and the stepping motors 251 and 291 are controlled accordingly. However, a control system that starts the mirror moving member 27 before the lens moving member 23 can be utilized without departing from the spirit or scope of the invention.

Furthermore, the origin point sensor 37 for the lens moving member 23 can be alternatively arranged on a the side of the lens 9 in the optical axis direction opposite to that shown in FIG. 1. In this case, the lens moving member 23 and mirror moving member 27 are moved to origin points in opposite directions.

Figure 9:
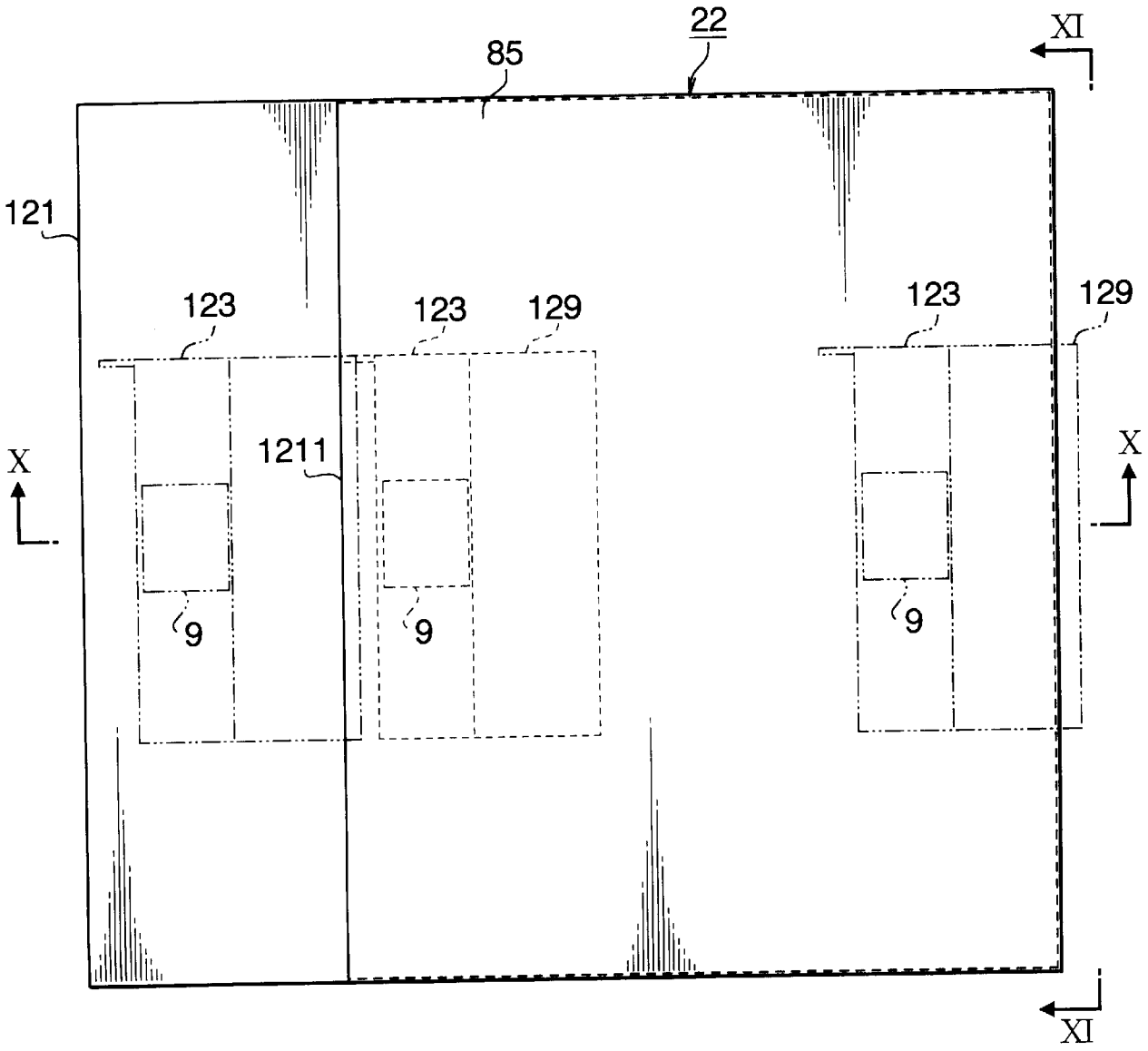
FIG. 9 is a schematic plan view of an illustrative example of a variable magnification optical system.
Figure 10:
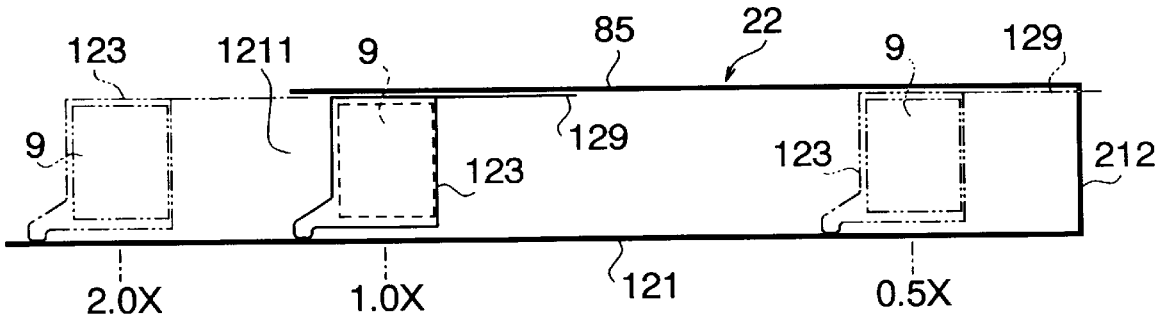
FIG. 10 is a schematic sectional view taken along the line X—X of FIG. 9.
Figure 11:
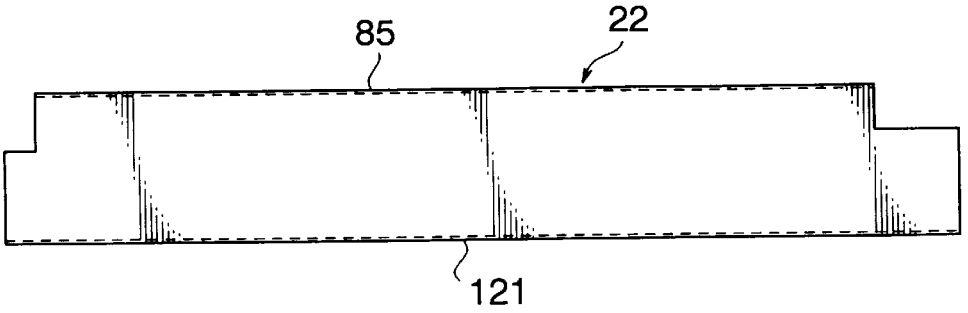
FIG. 11 is a schematic rear view taken from line XI—XI of FIG. 9.
Figure 12:
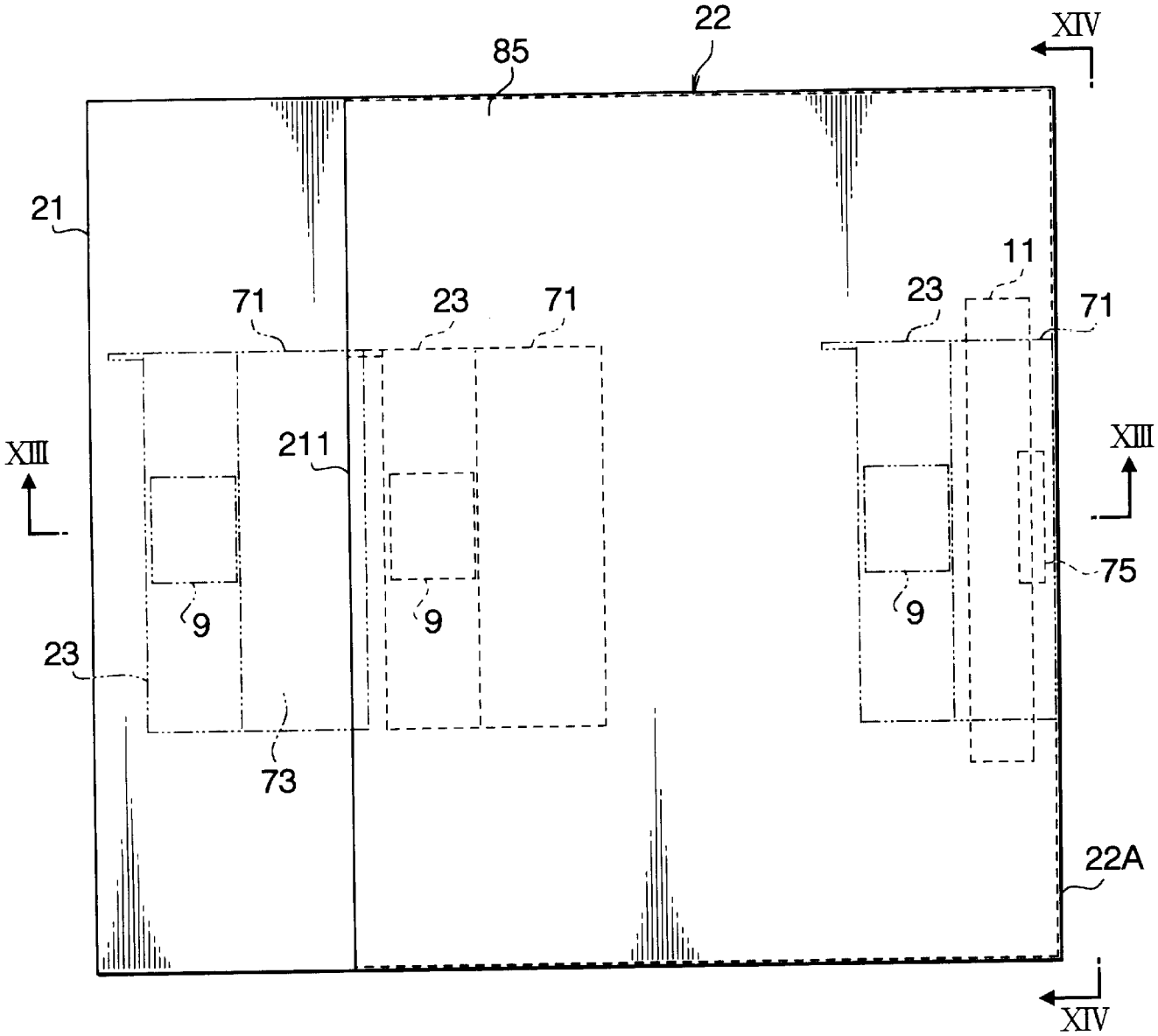
FIG. 12 is a schematic plan view showing moving positions of a lens moving member according to a second embodiment of a variable magnification optical system according to the invention.
Figure 13:
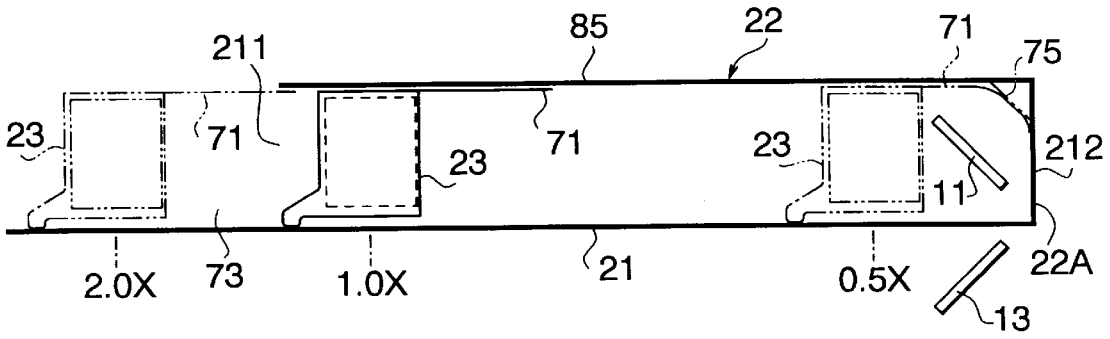
FIG. 13 is a schematic sectional view taken along the line XIII—XIII of FIG. 12.
Figure 14:
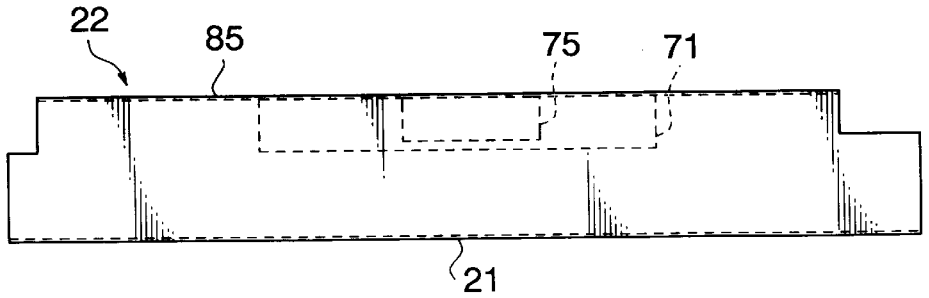
FIG. 14 is a schematic rear view taken from line XIV—XIV of FIG. 12.

A second embodiment of a variable magnification optical system is shown in FIGS. 12 through 14, while FIGS. 9 through 11 show a comparative example for illustrating the problem solved by the second embodiment.

FIG. 9 is a schematic plan view of the comparative example; FIG. 10 is a schematic sectional view taken along the line X—X of FIG. 9; and FIG. 11 is a schematic rear view from line XI—XI of FIG. 9. As illustrated in FIGS. 9 through 11, showing a comparative example, a lens 9 o f a variable magnification optical system is usually enclosed in a housing 22 that shields external light other than that for reading the original document. The housing 22 includes a rectangular base plate 121 extending in the optical axis direction. The rectangular base plate 121 has side walls for light shielding at left and right sides and the rear side. A light shielding cover 85 shorter than the base plate 121 covers the upper portion of the base plate 121. The cover 85 is shorter than the base plate 121 to prevent the interference of a scanning mirror with the cover 85 when the scanning mirror is moved.

The remaining end of the housing 22 (the left side in FIG. 9) has an opening 211 formed therein to allow the introduction of the reading and scanning light from the original document. On the base plate 121 in the housing 22, a lens moving member 123 accommodating the lens 9 is provided to be movable along an optical axis direction (the left and right direction in FIG. 9) by means of a drive means (not shown) from a 2.0× magnification position (shown by a double dotted line in FIGS. 9 and 10) to a 0.5× magnification position (shown by a single dotted line in FIGS. 9 and 10). A flat plate light shielding member 129 made of, for example, metal, is horizontally secured to the lens moving member 123. The flat plate light shielding member 129 is intended to shield the stray light, such as that diffusely reflected from the original document from above the housing 22, when the lens moving member 123 is in the 2.0× magnification position, below the opening 211 and outside of the covering area of the cover 85.

However, when the lens moving member 123 is moved to the 0.5× magnification position, the flat plate light shielding member 129 interferes with a rear side wall 212 of the base plate 121. Accordingly, it becomes necessary to either form an opening in the rear side wall 212 of the base plate 121 for allowing the front end portion of the shielding member 129 to protrude, or to make the housing 22 longer in the optical axis direction. Furthermore, if the front end portion of the shielding member 129 is allowed to protrude from an opening formed in the rear side wall 212 of the base plate 121, it becomes necessary to have a vacant space at the rear side wall 212 of the housing 22, making it difficult to use the rear side of the housing 22 for useful mechanisms. Alternatively, if the housing 22 is elongated, the variable magnification optical system is enlarged by that amount.

FIG. 12 is a schematic plan view showing moving positions of a lens moving member 23 according to a second embodiment of the invention; FIG. 13 is a schematic sectional view taken along the line XIII—XIII of FIG. 12; and FIG. 14 is a schematic rear view from line XIV—XIV of FIG. 12. As shown in FIGS. 12 through 14, in the second embodiment according to the invention, the variable magnification optical system, having many similar parts to that described for the first embodiment, includes the lens moving member 23, the magnification mirrors 11 and 13, and a housing 22. The housing 22 includes the rectangular base plate 21 elongated in the optical axis direction, and having light shielding side walls at left, right, and rear sides. A light shielding cover 85 is provided for covering the upper side of the base plate 21. A closed end portion 22A, at one end of the housing 22 in the optical axis direction is closed by a side wall 212 of the base plate 21. At the remaining end in the optical axis direction, an opening 211 is formed for allowing the reading and scanning light from the original document to enter the variable magnification optical system between the base plate 21 and the light shielding cover 8S. The magnification mirrors 11 and 13 are arranged toward the closed end 22A of the housing 22 to be movable in the optical axis direction. The first magnification mirror 11 is arranged within the housing 22, while the second magnidication mirror 13 is arranged below the base plate 21. An opening (not shown) formed in the base plate 21 allows light reflected from the first magnification mirror 11 to reach the second magnification mirror 13.

A flexible plate shielding member 71 is formed on the upper portion of the lens moving member 23 extending in the light exit direction of the lens 9. The flexible plate shielding member is formed of rubber or synthetic resin, and is capable of being elastically deformed. As shown in FIG. 13, the flexible plate shielding member 71 is sized to shield stray light intruding from above the housing 22 by closing the space 73 formed between the lens moving member 23 and the light shielding cover 85 when the lens moving member 23 is in the 2.0× magnification position, outside the covering area of the light shielding cover 85.

A guide member 75 extends obliquely downwardly toward the near end side wall 212 of the base plate 21 from the lower surface of the light shielding cover 85 at the closed end portion 22A side (in the optical axis direction) of the housing 22. As shown in FIG. 13, the guide member 75 curves the front end portion of the shielding member 71 downwardly when the lens moving member 23, is moved to or is in the 0.5× magnification position, and is formed as a plate made of metal or synthetic resin.

As shown in FIGS. 12 and 13, in the second embodiment of the variable magnification optical system as described, when the lens moving member 23 is moved to the 2.0× magnification position at one end of its moving range, the space 73 formed between the lens moving member 23 and the light shielding cover 85 is shielded by the flexible light shielding member 71, so that any stray light apt to intrude into the housing 22 through the space 73 is shielded. Further, as shown in FIGS. 12 and 13, when the lens moving member 23 is in or is moved to the 0.5× magnification position at the remaining and of its moving range, since the flexible light shielding member 71 resiliently curves down as it contacts the guide member 75, the flexible light. shielding member does not interfere with the rear end side wall 212 of the housing 22. Accordingly, the flexible light shielding member 71 does not restrict the movement of the lens moving member 23, nor does it require an enlarged housing in order to allow the lens moving member 23 to be positioned.

Other than the flexible light shielding member 71 and the guide member 75, the mechanism and operation of the second embodiment of a variable magnification optical system according to the invention is the same as that described previously as that to which the embodiments of the present invention are applied.

Figure 15:
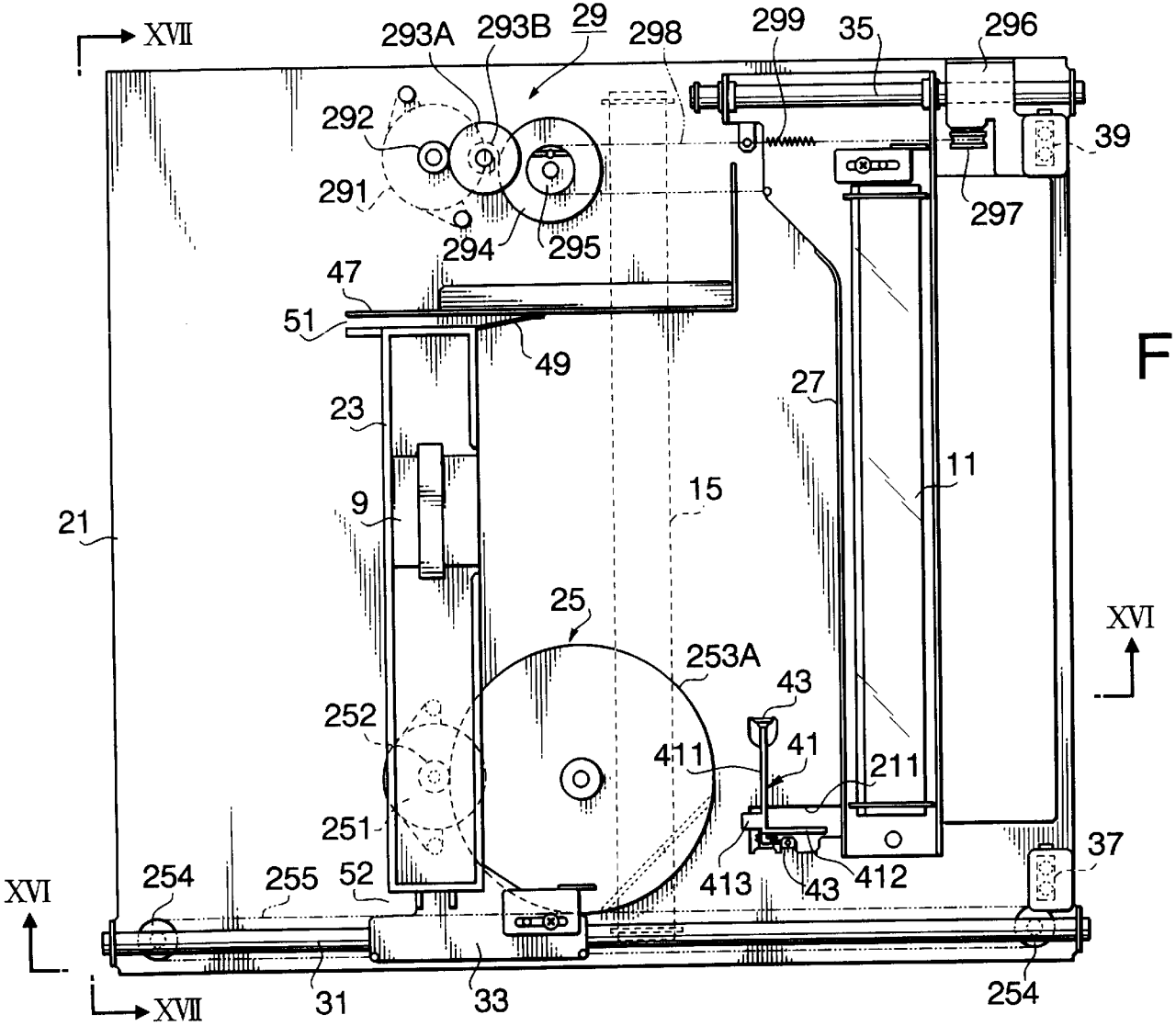
FIG. 15 is a plan view of a third embodiment of a variable magnification optical system according to the invention.
Figure 16:
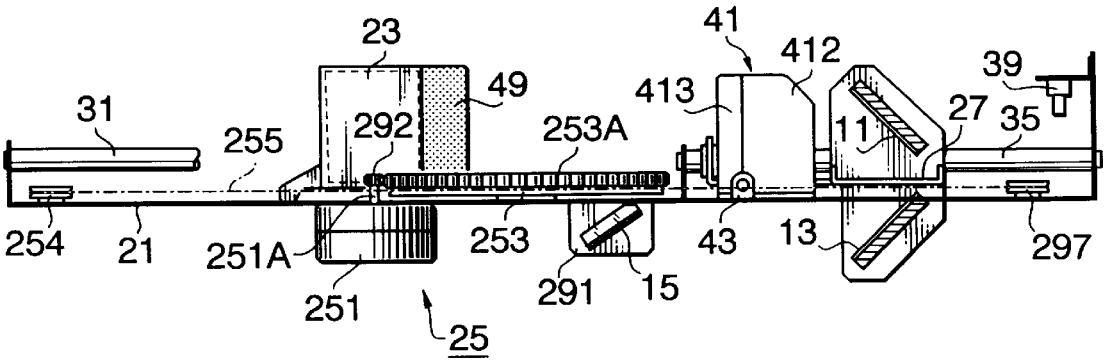
FIG. 16 is a cross-sectional side view taken along the line XVI—XVI of FIG. 15.
Figure 17:
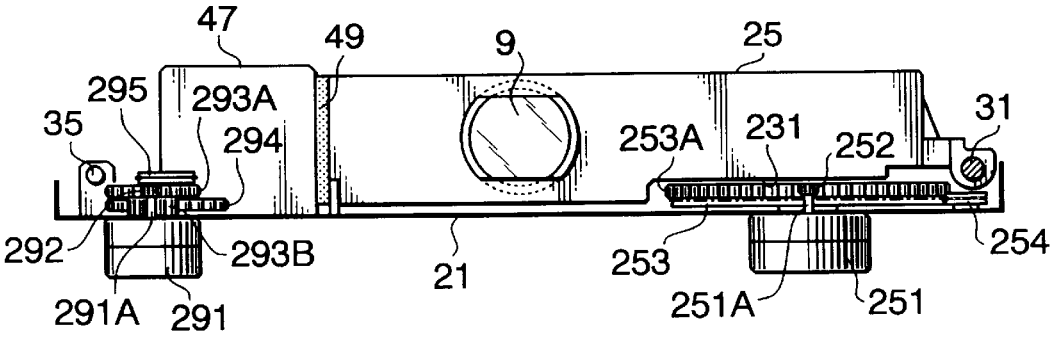
FIG. 17 is a front view taken from line XVII—XVII of FIG. 15.
Figure 18:
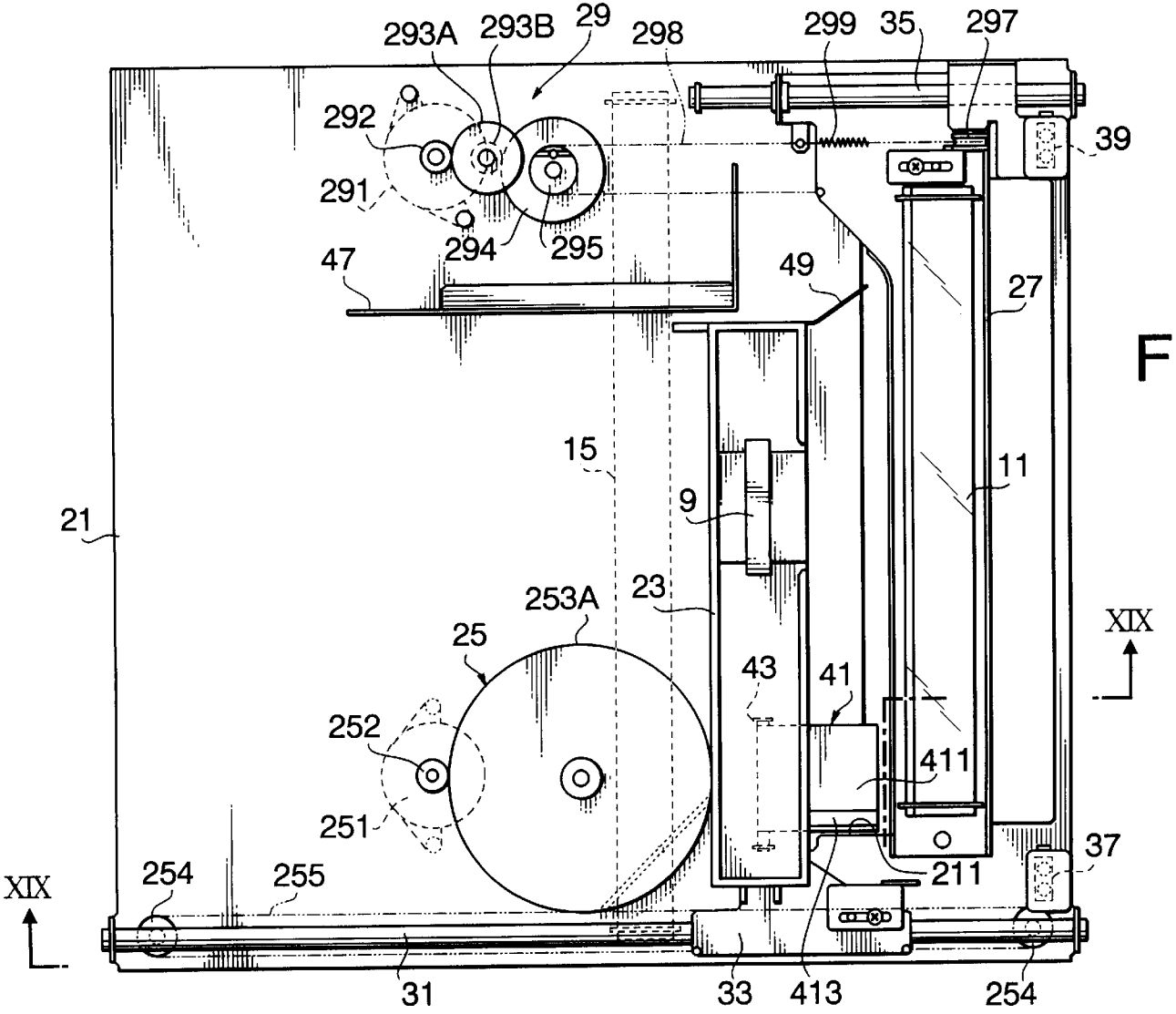
FIG. 18 is a plan view of a third embodiment of a variable magnification optical system according to the invention, showing a second position of a lens and magnification mirrors.
Figure 19:
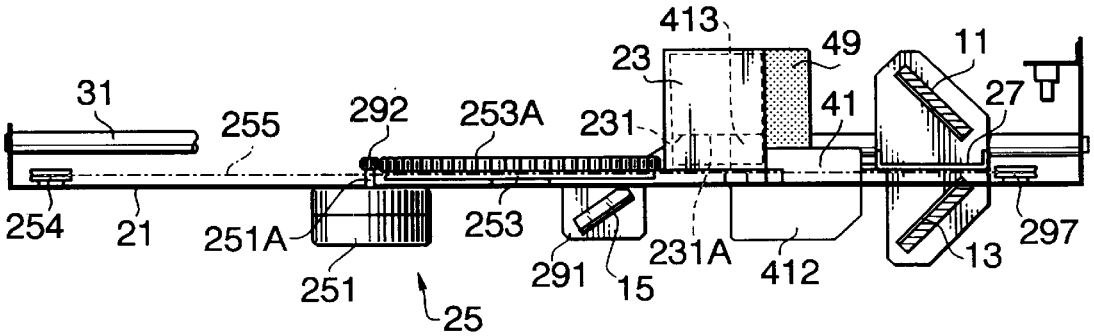
FIG. 19 is a cross-sectional side view taken along the line XIX—XIX of FIG. 19.

FIG. 15 is a plan view of a third embodiment of a variable magnification optical system according to the invention; FIG. 16 is a cross-sectional side view taken along the line XVI—XVI of FIG. 15; FIG. 17 is a front view taken from line XVII—XVII of FIG. 15; FIG. 18 is a plan view of a third embodiment of a variable magnification optical system according to the invention, showing a second position of the lens 9 and magnification mirrors 11 and 13; FIG. 19 is a cross-sectional side view taken along the line XIX—XIX of FIG. 19; and FIG. 20 is a perspective view of a light shielding member 41 according to the third embodiment.

Excepting the following description, the mechanism and operation of the third embodiment of a variable magnification optical system according to the invention is the same as that described previously as that to which the embodiments of the present invention are applied.

As shown in FIGS. 17 and 19, in the third embodiment of a variable magnification optical system according to the invention, a cut off portion 231 is formed at the lower surface of the lens moving member 23, facing the upper surface of the base plate 21, to engage a light shielding member 41 (described later) while avoiding interference with the drive pulley 253. Also shown in FIGS. 15 through 20, a light shielding member 41 for shielding stray light is provided on the base plate 21 on the guide rod 31 side, i.e., on the mirror moving member 27 lateral side, within the moving range of the lens moving member 23.

Figure 20:
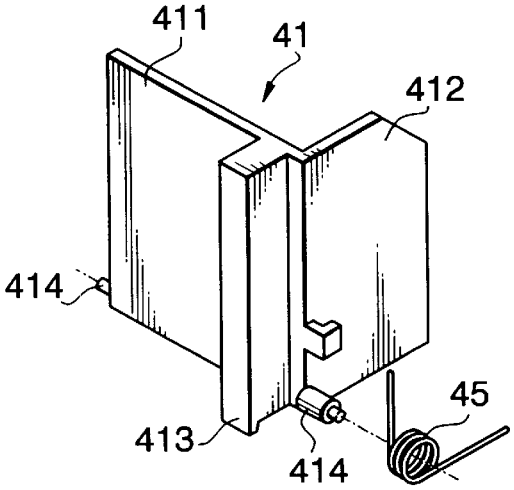
FIG. 20 is a perspective view of a light shielding member according to the third embodiment.

From the viewpoint of FIG. 20, "front" and "rear" correspond to the visible and hidden sides of a first light shielding piece 411 of the light shielding member 41, respectively. As illustrated in FIG. 20, the light shielding member 41 is provided with a first light shielding piece 411 having a predetermined surface area, a second light shielding piece 412 parallel to the guide rod 31 and formed at a right angle to a rear side of the first light shielding piece 411, a shaft portion 414 horizontally protruding from opposite sides of the lower portion of the light shielding piece 411, and a stopper 413 provided to the front surface side of the light shielding piece 411. The stopper 413 includes a flat bottom to hold the light shielding member 41 in an upright position and prevent swinging in a direction opposite to the direction of movement of the lens moving member 23 when the lens moving member moves from the 2.0× magnification position toward the 0.5× magnification position.

As illustrated in FIGS. 15 and 18, the light shielding member 41, is rotatably supported on the base plate 21 to swing in the direction of movement of the lens moving member 23. That is, the shaft portion 414 is rotatably held by mounts 43, 43 formed on the base plate 21. The mounts 43, 43 are preferably formed by bending a portion of the base plate 21. A torsion spring 45 surrounds one of the shaft portions 414. One end of the torsion spring 45 engages the light shielding member 41 and the remaining end of the torsion spring 45 engages the base plate 21. The torsion spring biases the light shielding member 41 toward an upright position, in a direction opposite to the direction of movement of the lens moving member 23 when the lens moving member moves from the 2.0× magnification position toward the 0.5× magnification position.

As shown in FIGS. 15 and 18, a light shielding plate 47 for shie1ding stray light is arranged on the base plate 21 along the moving direction of the lens moving member 23, adjacent the side surface of the lens moving member 23 on the same lateral side as the mirror drive mechanism 29. The light shielding plate 47 prevents leakage of stray light generated by diffuse reflection from the original document toward the magnification mirror 11. A space 51 is formed in the clearance between the light shielding plate 47 and the lens moving member 23. A resilient light shielding flap 49 prevents leakage of stray light toward the magnification mirror 11 through the space 51. One end of the resilient light shielding flap 49 is secured to the lens moving member 23; while the remaining end, resiliently swingable, slidably contacts the side surface of the light shielding plate 47.

In operation, the third embodiment of a variable magnification optical system according to the invention moves the lens moving member 23 between positions as previously described with reference to FIG. 4. That is, the lens 9 has a continuous moving range between a 2.0× magnification position (shown by a single dotted line in FIG. 4) through a 1.0× magnification position (shown by a solid line in FIG. 4) to a 0.5× magnification position (shown by a double dotted line in FIG. 4), and back.

When the lens moving member 23 is moved between the 2.0× magnification position and 1.0× magnification position in either direction, the positional relations of the lens moving member 23 and mirror moving member 27 are as illustrated in FIG. 15, and the light shielding member 41 is held in an upright position as illustrated in FIGS. 15 and 16. stray light apt to intrude to the magnification mirror 11 through the space 52 at the guide rod 31 side of the lens moving member 23 is blocked by the upright light shielding member 41 in the 2.0× magnification position. Furthermore, the resilient light shielding flap 49 prevents leakage of stray light toward the magnification mirror 11 through the space 51 by contacting the side surface of the light shielding plate 47 and blocking the space 51.

When the lens moving member 23 is moved between the 1.0× magnification position to the 0.5× magnification position, the lens moving member 23 and the mirror moving member 27 are moved to the positions illustrated in FIG. 4 by double dotted lines. As the lens moving member 23 is moved to the 0.5× position, the leading surface of the lens moving member 23 (facing the light shielding member 41) contacts and swings the stopper 413 of the light shielding member 41 about the shafts 414, 414. As the lens moving member is further moved to the 0.5× magnification position, the movement of the lens moving member 23 gradually inclines the light shielding member 41 toward the mirror moving member 27 against the biasing force of the torsion spring 45.

As shown in FIG. 19, as the light shielding member 41 becomes horizontal, the stopper.413 passes under the lower surface 231A of the cut off portion 231 of the lens moving member 23 on the front side of the first light shielding piece 411. Upon further movement of the lens moving member 23 approaching the 0.5× magnification position, the stopper 413 of the light shielding member 41 completely engages the lower surface 231A of the cut off portion 231. Accordingly, the light shielding member 41 is inclined until the first light shielding piece 411 is parallel with the bottom surface of the base plate 21, as shown in FIGS. 18 and 19, and is held in the inclined condition (parallel to the bottom of the base plate 21) by the cut off portion 231. simultaneously, the second light shielding piece 412 of the light shielding member 41 protrudes through the opening 211 in the base plate 21 to the underside of the base plate 21. Accordingly, the lens moving member 23 can be moved to the 0.5× magnification position without interfering with the lens shielding member 41.

It should be noted that even when the lens moving member 23 is returned to its origin point position $P_{OL}$ on the magnification mirror 11 side, past the 0.5× magnification position, the light shielding member 41 is positioned below the cut-off portion 231.

In the third embodiment of a variable magnification optical system, the light shielding member 41 arranged within the moving range of the lens moving member 23, and is provided on the base plate 21 in a swingable fashion. Accordingly, the lens moving member 23 can be moved to the 0.5× magnification position without interfering with the light shielding member 41. Furthermore, while the lens moving member 23 is being moved to the 2.0× magnification position or 1.0× magnification position, the light shielding member 41 is held in an upright position, and stray light reflected from the original document can be surely blocked from intruding to the magnification mirror 11 side via the space 52. Still further, as the flexible light shielding member 49 is provided on the lens moving member 23 and slidably contacting the side surface of the light shielding plate 47, stray light reflected from the original document is surely blocked from intruding through the space 51 formed between the side end of the lens moving member 23 and the light shielding plate 47.

Although the embodiments are representative of the case where the variable magnification optical system is employed in a copier, the present invention can be applied to other types of optical reading or scanning devices without departing from the spirit or scope of the invention.

The present disclosure relates to subject matter contained in Japanese Patent Application Nos. HEI 07-119263, HEI 07-119264, and HEI 07-119265 all filed on Apr. 20, 1995, which are expressly incorporated herein by reference in their entireties.

What is claimed is:

1. A variable magnification optical system for projecting an image onto a projection surface, comprising:

a lens for forming an image of an original document on the projection surface, said lens having an optical axis;

a lens moving member supporting said lens;

a mirror group arranged between said lens and the projection surface, for directing light from said lens to the projection surface;

a lens driving mechanism that drives the lens moving member in a direction of the optical axis of said lens to vary the magnification of the projected image;

a housing having a bottom base plate, a front side at one end in the direction of said optical axis, and a rear side in the direction of said optical axis, said housing being open at a top side, and said housing accommodating said lens, said lens moving member, said mirror group, and said lens driving mechanism;

a light shielding cover shielding a top side of said base plate and extending from said rear side of said housing toward said front side of said housing, a space for allowing image-forming light into said housing being formed between said light shielding cover and said front side of said housing;

a flexible light shielding member attached to an upper portion of said lens moving member, said flexible light shielding member extending in the direction of said rear side of said housing, and said flexible light shielding member sized to block said space between said light shielding cover and said front side of said housing; and a guide member formed at said rear side of said housing for urging said flexible light shielding member in a downward direction when said lens moving member is moved to said rear side of said housing.

2. The variable magnification optical system according to claim 1, said flexible light shielding member being formed of a resilient material having elasticity.

3. The variable magnification optical system according to claim 1, wherein said guide member is attached to said light shielding cover.

4. The variable magnification optical system according to claim 1, further comprising:

a mirror driving mechanism that drives said mirror group in a direction of the optical axis of said lens to vary a magnification of the projected image in response to the driving of said lens moving member.

5. A variable magnification optical system for projecting an image onto a projection surface, comprising:

a lens for forming an image of an original document on the projection surface;

a lens moving member supporting said lens;

a mirror group arranged between said lens and the projection surface, for directing light from said lens to the projection surface;

a mirror moving member supporting said mirror group;

a lens driving mechanism that drives said lens moving member in a direction of an optical axis of said lens to vary a magnification of the projected image;

a housing accommodating said lens, a lens moving member, said mirror group, said mirror moving member, and said lens driving mechanism;

a light shielding member, inclinably supported by a portion of said housing in said moving range of said lens moving member, that blocks light from passing beside said lens moving member to said mirror group when said light shielding member is in an upright position; and a biasing member that biases said light shielding member to said upright position.

6. The variable magnification optical system according to claim 5, further comprising:

a pivot support provided on a surface of said housing in a moving range of said lens moving member that swingably supports said light shielding member to be inclinable and swingable about an axis.

7. The variable magnification optical system according to claim 5, said lens moving member comprising a surface contactable to said light shielding member, wherein said lens moving member inclines said light shielding member when said surface contacts and pushes said light shielding member.

8. The variable magnification optical system according to claim 7, said surface contactable to said light shielding member being a cutoff portion formed in said lens moving member and facing said portion of said housing supporting said light shielding member.

9. The variable magnification optical system according to claim 5, further comprising:

a flexible light shielding member attached to a side portion of said lens moving member, said flexible light shielding member extending away from said lens moving member and toward said housing, and said flexible light shielding member sized to block a space between said lens moving member and a side of said housing.

10. The variable magnification optical system according to claim 5, further comprising a mirror driving mechanism that drives said mirror moving member in the direction of the optical axis of said lens to vary the magnification of the projected image in response to said driving of said lens moving member.

* * * * *